US007933418B2

(12) United States Patent
Morishima

(10) Patent No.: US 7,933,418 B2
(45) Date of Patent: Apr. 26, 2011

(54) SOUND REPRODUCING APPARATUS AND METHOD OF IDENTIFYING POSITIONS OF SPEAKERS

(75) Inventor: Morito Morishima, Hamamatsu (JP)

(73) Assignee: Yamaha Corporation (JP)

( * ) Notice: Subject to any disclaimer, the term of this patent is extended or adjusted under 35 U.S.C. 154(b) by 505 days.

(21) Appl. No.: 10/589,783

(22) PCT Filed: Feb. 16, 2005

(86) PCT No.: PCT/JP2005/002833

§ 371 (c)(1),
(2), (4) Date: Aug. 17, 2006

(87) PCT Pub. No.: WO2005/079114

PCT Pub. Date: Aug. 25, 2005

(65) Prior Publication Data

US 2007/0133813 A1 Jun. 14, 2007

(30) Foreign Application Priority Data

Feb. 18, 2004 (JP) ..... 2004-041237

(51) Int. Cl.
*H04R 29/00* (2006.01)

(52) U.S. Cl. ..... 381/59; 381/300; 381/303; 381/58; 381/105

(58) Field of Classification Search ..... 381/104–105, 381/107, 300, 58–59, 302–303, 306–307
See application file for complete search history.

(56) References Cited

U.S. PATENT DOCUMENTS 6,839,676 B2 * 1/2005 Saito ..... 704/500
6,954,538 B2 * 10/2005 Shiraishi ..... 381/105
7,155,017 B2 * 12/2006 Kim et al. ..... 381/59
2003/0031333 A1 * 2/2003 Cohen et al. ..... 381/303
2004/0131207 A1 * 7/2004 Park ..... 381/104

(Continued)

FOREIGN PATENT DOCUMENTS

JP 01-276900 A 11/1989

(Continued)

OTHER PUBLICATIONS

Relevant portion of International Search Report of corresponding PCT Application PCT/JP2005/002833.

(Continued)

*Primary Examiner* — Devona E Faulk
*Assistant Examiner* — Disler Paul
(74) *Attorney, Agent, or Firm* — Rossi, Kimms & McDowell LLP

(57) ABSTRACT

A position of a speaker is detected two-dimensionally or three-dimensionally, and a sound field is corrected. A sound reproducing apparatus includes a measuring signal generating portion for generating a first measuring signal, a transmission portion for transmitting a second measuring signal as soon as the first measuring signal is generated, sensors disposed in a listening position and for measuring a time difference between a time instant when the second measuring signal was received and a time instant when a measuring sound wave radiated from a to-be-detected speaker in accordance with the first measuring signal was received, and a position calculating portion for calculating a distance, as to each of n sensors, between each of the n sensors and the to-be-detected speaker based on the measured time difference, and calculating the position of the to-be-detected speaker based on distances among the n sensors and the calculated distance.

5 Claims, 11 Drawing Sheets

U.S. PATENT DOCUMENTS

| | | | | |
|---|---|---|---|---|
| 2004/0228498 | A1* | 11/2004 | Sekine | 381/303 |
| 2004/0258259 | A1* | 12/2004 | Koyama | 381/307 |
| 2005/0152557 | A1* | 7/2005 | Sasaki et al. | 381/58 |
| 2006/0210101 | A1* | 9/2006 | Ishibashi et al. | 381/300 |

FOREIGN PATENT DOCUMENTS

| | | | |
|---|---|---|---|
| JP | 11-113099 | A | 4/1999 |
| JP | 2000-354300 | A | 12/2000 |
| JP | 2002-199487 | A | 7/2002 |
| JP | 2003-92799 | A | 3/2003 |

OTHER PUBLICATIONS

Office Action issued in corresponding Japanese Patent Application No. 2004-041237, mailing date Jun. 3, 2008.

Decision of Refusal, dated Sep. 9, 2008, issued in corresponding JP application No. 2004-041237.

* cited by examiner

SOUND REPRODUCING APPARATUS AND METHOD OF IDENTIFYING POSITIONS OF SPEAKERS

This is a U.S. National Phase Application of PCT International Application PCT/JP2005/002833 filed on Feb. 16, 2005.

TECHNICAL FIELD

The present invention relates to a sound reproducing apparatus for reproducing multi-channel sound, and particularly, relates to a sound reproducing apparatus and a method of identifying positions of speakers in which positions of speakers are detected two-dimensionally or three dimensionally so that a sound field can be corrected effectively.

TECHNICAL BACKGROUND

Recently, multi-channel audio signals such as 5.1-channel audio signals are recorded in some audio sources such as DVDs. Multi-channel sound reproducing systems for reproducing such audio sources have been coming into wide use even in general homes. In such a multi-channel sound reproducing system, a multi-channel sound reproducing effect expected by an audio equipment maker can be obtained when respective speakers are disposed in a listening room according to a layout method recommended by the maker. It is therefore likely that sound image localization will be out of place if the layout of the speakers is greatly different from the recommended layout.

Therefore, there has been proposed a sound image localization adjusting apparatus in which positions of speakers are detected, and a correction process is performed on audio signals output from the speakers based on the detected positions so as to correct the sound image localization (for example, see Patent Document 1).

Prior to filing of this description, the present inventor had found no prior-art document pertaining to the present invention except the prior-art document specified in prior-art document information described in this description.

Patent Document 1: JP-A-11-113099

However, the sound image localization adjusting apparatus in Patent Document 1 detects positions of speakers in a one-dimensional detection method in which the distance between an amplifier and each speaker is measured based on the length of a speaker cable. The sound image localization adjusting apparatus does not detect the positions of the speakers two-dimensionally or three-dimensionally. According to the sound image localization adjusting apparatus in Patent Document 1, it is therefore impossible to obtain an angle of each speaker with respect to an optimal listening position. Even if this angle is greatly different from that in a recommended position, the inappropriate layout of the speakers cannot be detected. Thus, there is a problem that only an in adequate sound image localization correction process can be performed.

DISCLOSURE OF THE INVENTION

The present invention was developed to solve the foregoing problems. An object of the present invention is to provide a sound reproducing apparatus and a speaker position identifying method in which positions of speakers are detected two-dimensionally or three-dimensionally so that a sound field can be corrected.

In order to attain the foregoing object, the present invention is characterized by including the following configurations.

(1) A sound reproducing apparatus for driving a plurality of speakers to reproduce multi-channel sound, the sound reproducing apparatus comprising:

generation means for generating a measuring signal and supplying the measuring signal to a to-be-detected speaker of the plurality of speakers;

at least two sensors disposed in a listening position, each of the at least two sensors transmitting a reception notification when receiving a measuring sound wave radiated from the to-be-detected speaker in accordance with the measuring signal;

time difference measuring means for measuring, as to each of the at least two sensors, a time difference between a time instant when the measuring signal is generated and a time instant when the reception notification is received from each of the at least two sensors;

distance calculating means for calculating, as to each of the at least two sensors, a distance between each of the at least two sensors and the to-be-detected speaker based on the measured time difference;

position calculating means for calculating a position of the to-be-detected speaker based on a distance between the at least two sensors and the calculated distance; and storage means for storing the calculated position of the to-be-detected speaker.

(2) The sound reproducing apparatus according to (1), comprising speaker layout correction means for changing over signal lines from an amplifier to the speakers and correcting an incorrect layout of the speakers when it is judged that respective speaker positions stored in the storage means are out of a predetermined relative position relationship of the speakers.

(3) The sound reproducing apparatus according to (1), comprising a sound field control means for producing sound image localization as if the speakers were located in predetermined recommended positions, respectively, based on respective positions of the speakers stored in the storage means.

(4) The sound reproducing apparatus according to (1), wherein a distance between at least two speakers of the plurality of speakers is known; and the position calculating means calculates a distance between the at least two sensors and positions of the at least two sensors based on distances between the at least two sensors and the at least two speakers calculated by the distance calculating means, and the distance between the at least two speakers.

(5) A sound reproducing apparatus for driving a plurality of speakers to reproduce multi-channel sound, the sound reproducing apparatus comprising:

generation means for generating a measuring signal and supplying the measuring signal to at least two measuring speakers of the plurality of speakers in turn, the measuring speakers having known positions with respect to a listening position;

a sensor that is attached to a to-be-detected speaker and transmits a reception notification as to each of the at least two measuring speakers when receiving a measuring sound wave radiated from each of the measuring speakers in accordance with the measuring signal;

time difference measuring means for measuring, as to each of the at least two measuring speakers, a time difference between a time instant when the measuring signal is generated and a time instant when the reception notification is received from the sensor;

distance calculating means for calculating, as to each of the at least two speakers, a distance between each of the measuring speakers and the to-be-detected speaker based on the measured time difference;

position calculating means for calculating a position of the to-be-detected speaker based on a distance between the at least two measuring speakers and the calculated distance; and storage means for storing positions of the at least two measuring speakers and the calculated speaker position.

(6) The sound reproducing apparatus according to (5), comprising a speaker layout correction means for changing over signal lines from an amplifier to the speakers and correcting an incorrect layout of the speakers when it is judged that respective speaker positions stored in the storage means are out of a predetermined relative position relationship of the speakers.

(7) The sound reproducing apparatus according to (5), comprising a sound field control means for producing sound image localization as if the speakers were located in predetermined recommended positions, respectively, based on respective speaker positions stored in the storage means.

(8) A method of identifying positions of a plurality of speakers by use of at least two sensors disposed in a listening position, the method comprising the steps of:

generating a measuring signal and supplying the measuring signal to one of the plurality of speakers;

transmitting a reception notification when each of the at least two sensors receives a measuring sound wave radiated from the to-be-detected speaker in accordance with the measuring signal;

measuring, as to each of the at least two sensors, a time difference between a time instant when the measuring signal is generated and a time instant when the reception notification is received from each of the at least two sensors;

calculating, as to each of the at least two sensors, a distance between each of the at least two sensors and the to-be-detected speaker based on the measured time difference;

calculating a position of the to-be-detected speaker based on a distance between the at least two sensors and the calculated distance; and providing a storage means for storing the calculated speaker position.

(9) The method according to (8) further comprising the step of changing over signal lines from an amplifier to the speakers and correcting an incorrect layout of the speakers when it is judged that stored positions of the speakers are out of a predetermined relative position relationship among the speakers.

(10) The method according to (8), further comprising the step of producing sound image localization as if the speakers were located in predetermined recommended positions respectively, based on stored positions of the speakers.

(11) The method according to (8), further comprising the steps of:

supplying the measuring signal in turn from the generation means to at least two measuring speakers of the plurality of speakers, the at least two measuring speakers has a known distance from each other; and transmitting, as to each of the two measuring speakers, a reception notification when each of the at least two sensors receives a measuring sound wave radiated from each of the measuring speakers in accordance with the measuring signal;

measuring, as to each of the at least two measuring speakers, a time difference between a time instant when the measuring signal is generated and a time instant when the reception notification is received from each of the at least two sensors;

calculating, as to each of the at least two measuring speakers, a distance between each of the at least two sensors and each of the measuring speakers based on the measured time difference; and calculating positions of the at least two sensors and a distance between the at least two sensors based on a distance between each of the at least two sensors and each of the measuring speakers and a distance between the at least two speakers.

BEST MODE FOR CARRYING OUT THE INVENTION

First Embodiment

Figure 1:
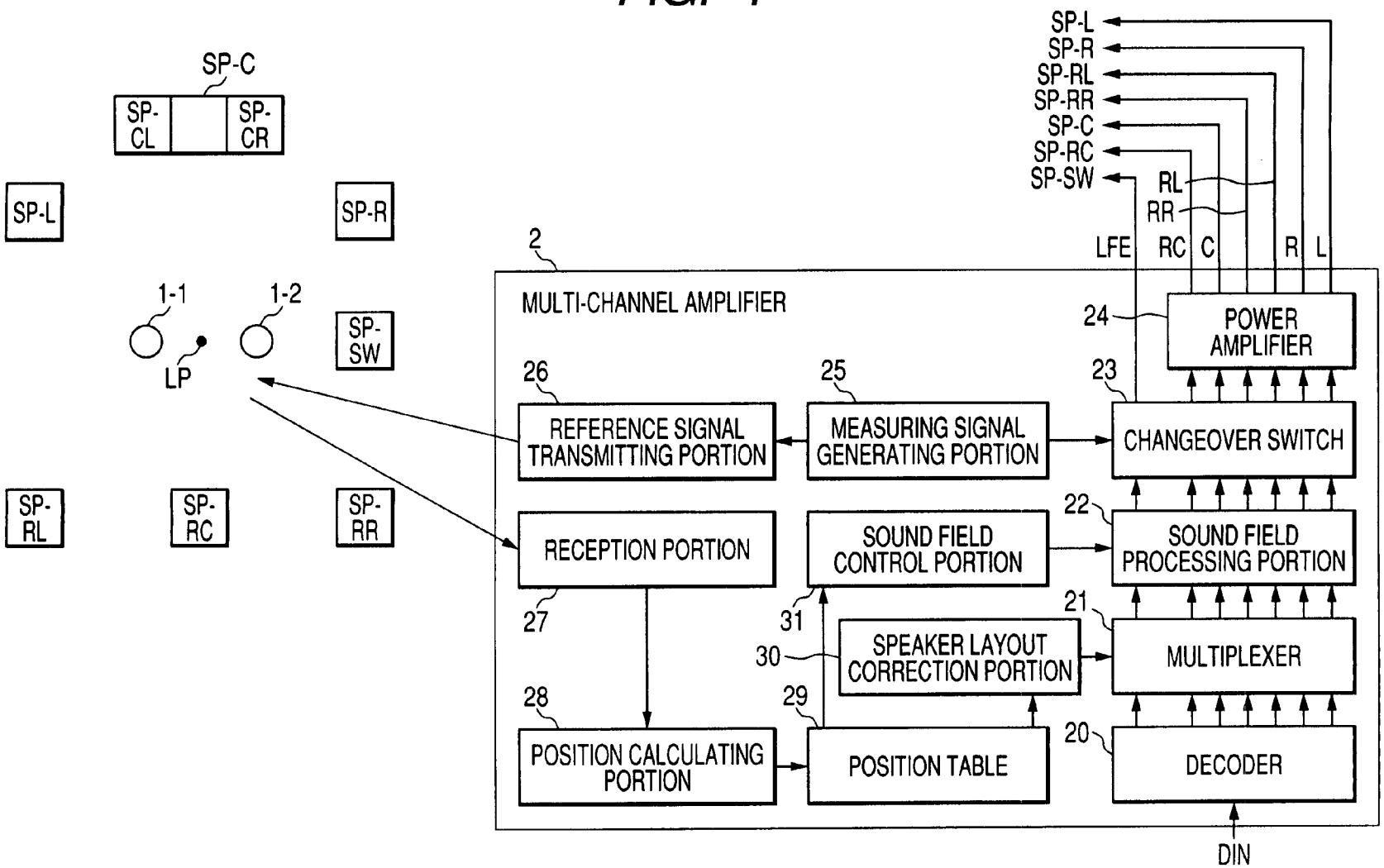
FIG. 1 is a block diagram showing the configuration of a sound reproducing apparatus according to a first embodiment of the present invention.

Embodiments of the present invention will be described below in detail with reference to the drawings. FIG. 1 is a block diagram showing the configuration of a sound reproducing apparatus according to a first embodiment of the present invention.

The sound reproducing apparatus in FIG. 1 includes sensors 1 (1-1 and 1-2) for detecting positions of speakers SP-C, SP-L, SP-R, SP-RL, SP-RR, SP-RC and SP-SW, and a multi-channel amplifier 2.

The multi-channel amplifier 2 includes a decoder 20, a multiplexer 21, a sound field processing portion 22, a changeover switch 23, a power amplifier 24, a measuring signal generating portion 25, a reference signal transmitting portion 26, a reception portion 27, a position calculating portion 28, a position table 29, a speaker layout correction portion 30 and a sound field control portion 31.

The measuring signal generating portion 25 constitutes a generation means. The reference signal transmitting portion 26 constitutes a transmission means. The position calculating portion 28 constitutes a distance calculating means and a position calculating means. The position table 29 constitutes a storage means. The speaker layout correction portion 30 and the multiplexer 21 constitute a speaker layout correction means. The sound field control portion 31 and the sound field processing portion 22 constitute a sound field control means.

Figure 2:
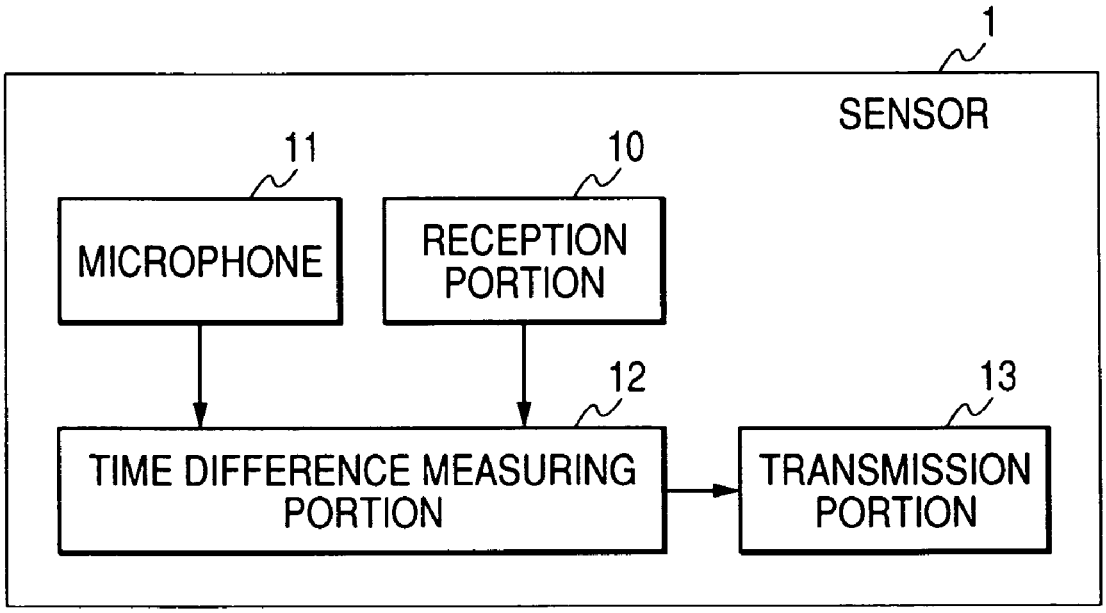
FIG. 2 is a block diagram showing the configuration of each sensor in the sound reproducing apparatus according to the first embodiment of the present invention.

FIG. 2 is a block-diagram showing the configuration of each sensor 1 (1-1, 1-2). The sensor 1 has a reception portion 10, a microphone 11, a time difference measuring portion 12 and a transmission portion 13.

This embodiment will be described using a 6.1-channel digital surround-sound system by way of example. Main speakers SP-L and SP-R, rear speakers SP-RL and SP-RR, a center speaker SP-C, a rear center speaker SP-RC and a subwoofer SP-SW are disposed in a listening room.

Brief description will be made on 6.1-channel reproduction. When, for example, a digital audio signal DIN compressed and encoded by Dolby® digital or the like is input, the decoder 20 of the multi-channel amplifier 2 generates audio signals of main signals L (left) and R (right), rear signals RL (rear left) and RR (rear right), a center signal C (center), a rear center signal RC (rear center) and a subwoofer signal LFE (low frequency). The main signals L and R, the rear signals RL and RR, the center signal C and the rear center signal RC are supplied to the power amplifier 24 through the multiplexer 21, the sound field processing portion 22 and the changeover switch 23. The main signals L and R, the rear signals RL and RR, the center signal C and the rear center signal RC amplified by the power amplifier 24 are supplied to the main speakers SP-L and SP-R, the rear speakers SP-RL and SP-RR, the center speaker SP-C and the rear center speaker SP-RC respectively. On the other hand, the subwoofer signal LFE is supplied to the subwoofer SP-SW through the multiplexer 21, the sound field processing portion 22 and the changeover switch 23. An amplifier is built in the subwoofer SP-SW. Thus, 6.1-channel reproduction is carried out.

Figure 3:
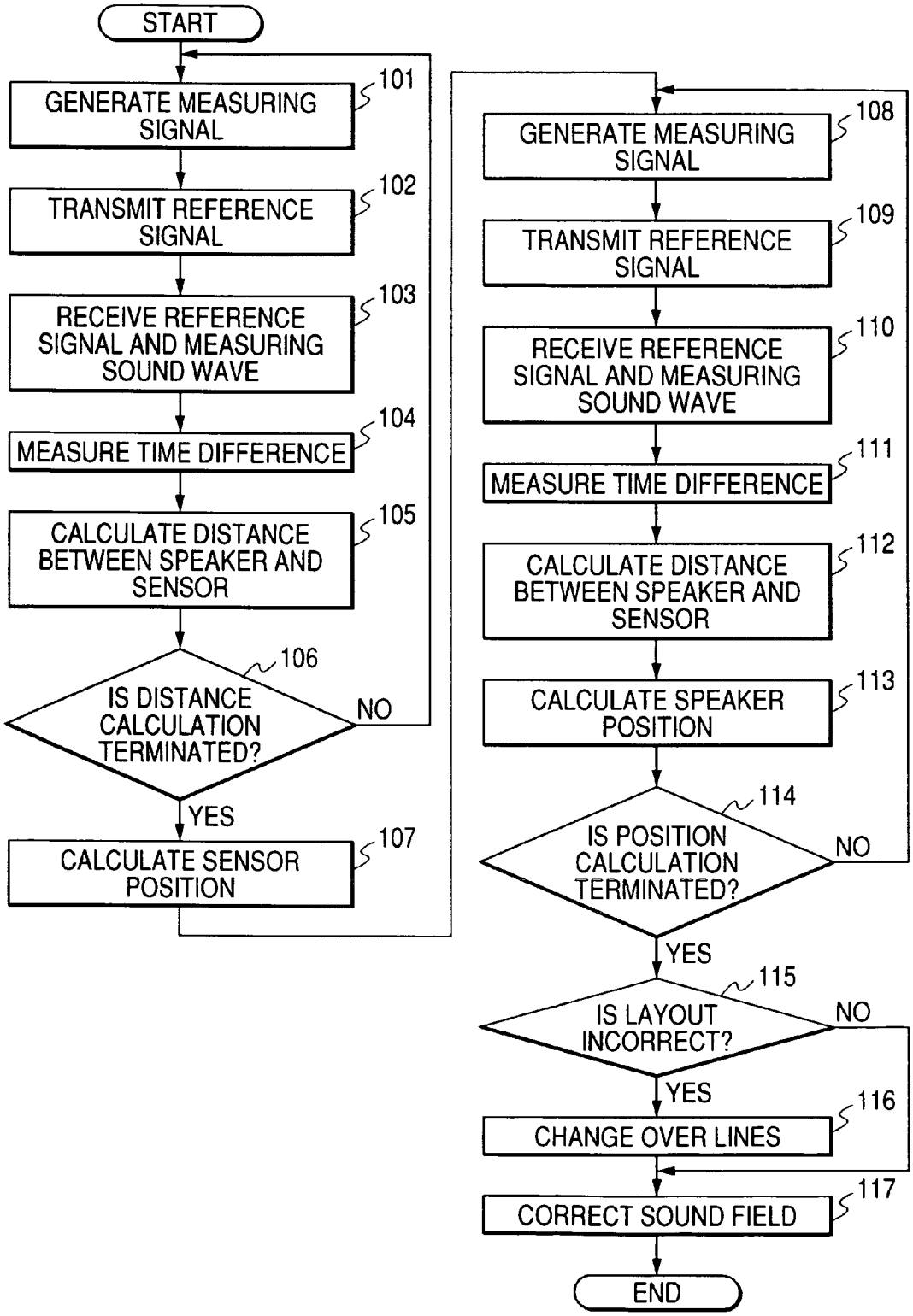
FIG. 3 is a flow chart showing a sound field correction process in the sound reproducing apparatus according to the first embodiment of the present invention.

Next, description will be made on an operation of detecting the positions of the speakers and performing sound field correction. FIG. 3 is a flowchart showing a sound field correction process according to this embodiment. First, a listener installs the sensors 1-1 and 1-2 in the listening room. In this event, the sensors 1-1 and 1-2 are disposed to put a listening position LP between the sensors 1-1 and 1-2.

The measuring signal generating portion 25 of the multi-channel amplifier 2 generates a first measuring signal for detecting a speaker position (Step 101 in FIG. 3). In this event, assume that the changeover switch 23 supplies the measuring signal to the center speaker (measuring speaker) SP-C, but does not supply the signal to the other speakers. In addition, assume that the measuring signal is supplied to only a left speaker SP-CL of the center speaker SP-C, for example, by a not-shown switch or the like in the center speaker SP-C, but the measuring signal is not supplied to a right speaker SP-CR of the center speaker SP-C.

The reference signal transmitting portion 26 of the multi-channel amplifier 2 transmits a reference signal (second measuring signal) to the sensors 1-1 and 1-2 as soon as the measuring signal is generated (Step 102). The reference signal is, for example, an infrared radiation or a radio wave. The reference signal may be transmitted by wire.

The reception portion 10 of the sensor 1-1 receives the reference signal transmitted from the multi-channel amplifier 2, and the microphone 11 then receives the measuring signal (measuring sound wave) radiated from the speaker SP-CL (Step 103).

Then, the time difference measuring portion 12 of the sensor 1-1 measures a time difference between a time instant when the reference signal was received and a time instant when the measuring sound wave was received, and notifies the transmission portion 13 of the measured time difference, and the transmission portion 13 sends a notification signal to the multi-channel amplifier 2 so as to notify the multi-channel amplifier 2 of this time difference (Step 104). The notification signal is, for example, an infrared radiation or a radio wave. The notification signal may be transmitted by wire.

As for how to measure the time difference, a time difference between a rising edge of the received reference signal and a rising edge of the received measuring sound wave may be measured simply when impulsive signals are used as the reference signal and the measuring sound wave respectively. Alternatively, the time difference may be measured from a phase difference between the received reference signal and the received measuring sound wave when periodical signals such as sine waves or the like are used as the reference signal and the measuring sound wave respectively. Measurement of the aforementioned time difference is also performed in the sensor 1-2. In order to distinguish a notification signal sent from the sensor 1-1 from a notification signal sent from the sensor 1-2, it is necessary to send, for example, identification information of the sensor 1-1, 1-2 in the notification signal together with the measured time difference.

The reception portion 27 of the multi-channel amplifier 2 receives a notification signal from each sensor 1-1, 1-2, and notifies the position calculating portion 28 of a time difference reported by this notification signal. The position calculating portion 28 calculates the distance between the speaker SP-CL and the sensor 1-1 based on the time difference measured by the sensor 1-1 and the sonic velocity, and calculates the distance between the speaker SP-CL and the sensor 1-2 based on the time difference measured by the sensor 1-2 and the sonic velocity (Step 105).

Figure 4:
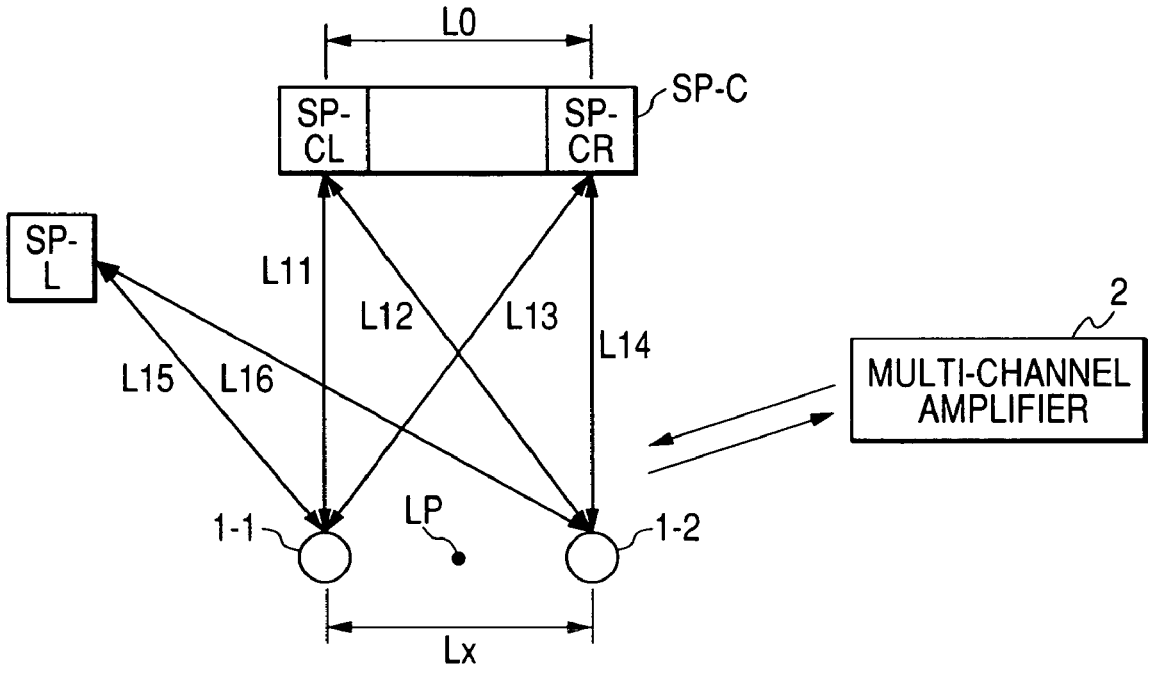
FIG. 4 is a diagram for explaining a process for calculating a distance between a speaker and a sensor according to the first embodiment of the present invention.

FIG. 4 is a diagram for explaining this process to calculate the distance between the speaker and each sensor. The distance between each sensor 1 and the multi-channel amplifier 2 is much shorter than the distance with which an electromagnetic wave travels per unit time. Accordingly, the time difference between the time instant when the reference signal was transmitted from the multi-channel amplifier 2 and the time instant when this reference signal reached the sensor 1-1, 1-2 can be regarded as approximately zero. Likewise, the distance between the speaker and the multi-channel amplifier 2 is much shorter than the distance with which an electric signal travels per unit time. Accordingly, the time difference between the time instant when the measuring signal was generated and the time instant when this measuring signal reached the speaker SP-CL can be also regarded as approximately zero. Thus, a distance L11 between the speaker SP-CL and the sensor 1-1 can be calculated based on the time difference measured by the sensor 1-1 and the sonic velocity, and a distance L12 between the speaker SP-CL and the sensor 1-2 can be calculated based on the time difference measured by the sensor 1-2 and the sonic velocity.

Subsequently, return to Step 101. Processing from Step 101 to Step 105 is carried out again. Here, assume that the measuring signal is supplied to only the right speaker SP-CR of the center speaker SP-C, but the measuring signal is not supplied to the left speaker SP-CL of the center speaker SP-C.

The position calculating portion 28 of the multi-channel amplifier 2 calculates a distance L13 between the speaker SP-CR and the sensor 1-1 based on the time difference measured by the sensor 1-1 and the sonic velocity, and calculates a distance L14 between the speaker SP-CR and the sensor 1-2 based on the time difference measured by the sensor 1-2 and the sonic velocity (Step 105).

After termination of calculation of the distances (YES in Step 106), the position calculating portion 28 calculates the position of the sensor 1-1 with respect to the center speaker SP-C trigonometrically from a known distance L0 between the speakers SP-CL and SP-CR and the calculated distances L11 and L13, and likewise calculates the position of the sensor 1-2 with respect to the center speaker SP-C from the distance L0 and the calculated distances L12 and L14 (Step 107). Assume that the position of the center speaker SP-C is an intermediate position between the speakers SP-CL and SP-CR.

When the positions of the sensors 1-1 and 1-2 are determined, a distance Lx between the sensors 1-1 and 1-2 can be obtained. In addition, a listening position LP can be determined because the listening position LP is located between the sensors 1-1 and 1-2 as described above. Thus, the position of the center speaker SP-C with respect to the listening position LP can be obtained based on this listening position LP and the positions of the sensors 1-1 and 1-2 with respect to the center speaker SP-C. The position calculating portion 28 stores the positions of the sensors 1-1 and 1-2 and the speaker SP-C with respect to the listening position LP and the distance Lx between the sensors 1-1 and 1-2 into the position table 29.

Next, the positions of the other speakers SP-L, SP-R, SP-RL, SP-RR, SP-RC and SP-SW are detected.

The measuring signal generating portion 25 of the multi-channel amplifier 2 generates a measuring signal for detecting a speaker position (Step 108). In this event, assume that the changeover switch 23 supplies the measuring signal to the main speaker SP-L but does not supply the signal to any other speaker when the speaker SP-L is set as a to-be-detected speaker.

Processing of Steps 109-111 is similar to that of Steps 102-104. A time difference between the time instant when the reference signal transmitted from the multi-channel amplifier 2 was received and the time instant when the measuring sound wave radiated from the speaker SP-L was received is measured by each sensor 1-1, 1-2. The multi-channel amplifier 2 is notified of the measured time difference through a notification signal.

The reception portion 27 of the multi-channel amplifier 2 receives the notification signal from each sensor 1-1, 1-2, and informs the position calculating portion 28 of the time difference reported by this notification signal. The position calculating portion 28 calculates a distance L15 between the speaker SP-L and the sensor 1-1 based on the time difference measured by the sensor 1-1 and the sonic velocity, and calculates a distance L16 between the speaker SP-L and the sensor 1-2 based on the time difference measured by the sensor 1-2 and the sonic velocity (Step 112).

Subsequently, the position calculating portion 28 calculates the position of the main speaker SP-L with respect to the sensors 1-1 and 1-2 trigonometrically from the distance Lx between the sensors 1-1 and 1-2 stored in the position table 29 and the calculated distances L15 and L16, and calculates the position of the main speaker SP-L with respect to the listening position LP based on this calculation result and the positions of the sensors 1-1 and 1-2 stored in the position table 29, so that the position calculating portion 28 stores this position of the speaker SP-L in the position table 29 (Step 113).

The processing of Steps 108-113 as described above are carried out upon the other speakers SP-R, SP-RL, SP-RR, SP-RC and SP-SW in turn. After termination of calculation of positions of the respective speakers (YES in Step 114), the speaker layout correction portion 30 determines whether there is an error in the relative position relationship among the speakers or not, based on the positions of the speakers SP-L, SP-R, SP-RL, SP-RR, SP-C and SP-RC and the subwoofer SP-SW stored in the position table 29 (Step 115). This determination process is to roughly determine whether the layout of the speakers is correct or incorrect. There are predetermined rules in the relative position relationship among the speakers, such that the main speaker SP-L must be on the left side of the center speaker SP-C, and the rear speaker SP-RL must be at the rear of the main speaker SP-L. It is determined whether each speaker has been disposed according to these rules or not.

When it is concluded in Step 115 that there is an error in the layout of the speakers, the speaker layout correction portion 30 controls the multiplexer 21 to change over the lines and thereby correct the incorrect layout of the speakers (Step 116). When, for example, the main speakers SP-L and SP-R are disposed inversely, main signals L and R to be supplied from the decoder 20 to the sound field processing portion 22 through the multiplexer 21 are replaced with each other. Thus, the incorrect layout of the speakers SP-L and SP-R can be corrected.

Next, the sound field processing portion 22 performs various sound field processes, if necessary, upon main signals L and R, rear signals RL and RR, a center signal C, a rear center signal RC and a subwoofer signal LFE which are input from the decoder 20 through the multiplexer 21. In this event, when the position of each speaker stored in the position table 29 is deviated from the predetermined recommended position of the speaker, the sound field control portion 31 controls the sound field processing portion 22 to correct the sound field to realize sound image localization as if the speaker were in the recommended position (Step 117). This sound field correction can be attained by the sound field processing portion 22 by adjusting a delay time, a gain, etc. of each signal supplied from the multiplexer 21.

In such a manner, according to this embodiment, the position of each speaker is detected two-dimensionally, and the sound field is corrected based on this detection result. Accordingly, even if the position of each speaker is largely deviated from its recommended position, it is possible to obtain a sufficient multi-channel sound reproducing effect.

When the distance Lx between the sensors 1-1 and 1-2 is known, the processing of Steps 101-107 does not have to be carried out, but it will go well if the positions of the speakers SP-L, SP-R, SP-RL, SP-RR, SP-C and SP-RC and the subwoofer SP-SW are detected in the processing of Steps 108-114.

Second Embodiment

Figure 5:
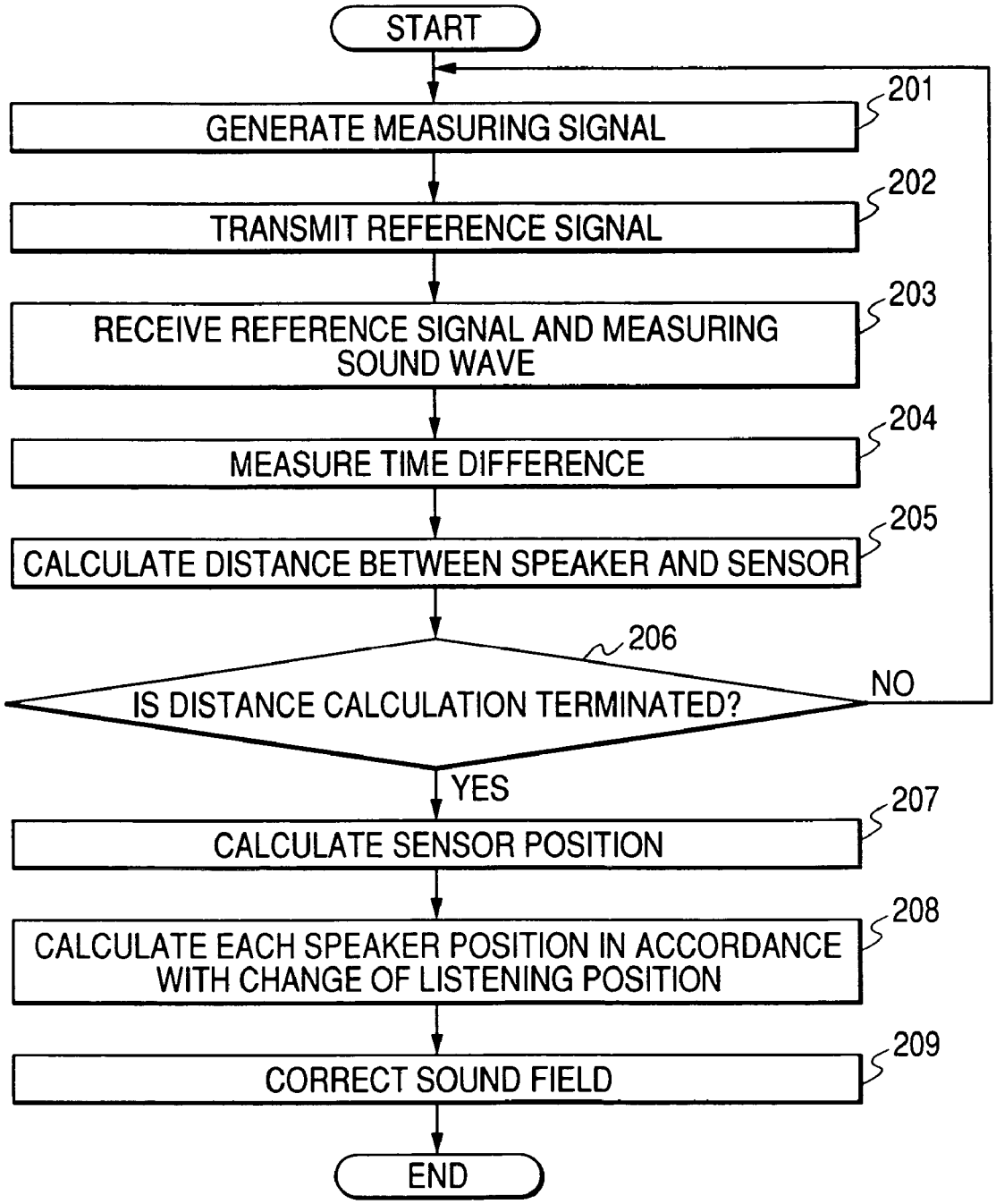
FIG. 5 is a flow chart showing a process when a listening position is changed according to a second embodiment of the present invention.

Next, description will be made on a second embodiment of the present invention. This embodiment is to explain operation in the case where the listening position LP is changed for some reason after the position of each speaker is detected in the first embodiment. Therefore, the configuration as the sound reproducing apparatus is the same as that in FIG. 1. Description will be made using the reference numerals in FIG. 1. FIG. 5 is a flow chart showing a process when the listening position LP is changed.

Figure 6:
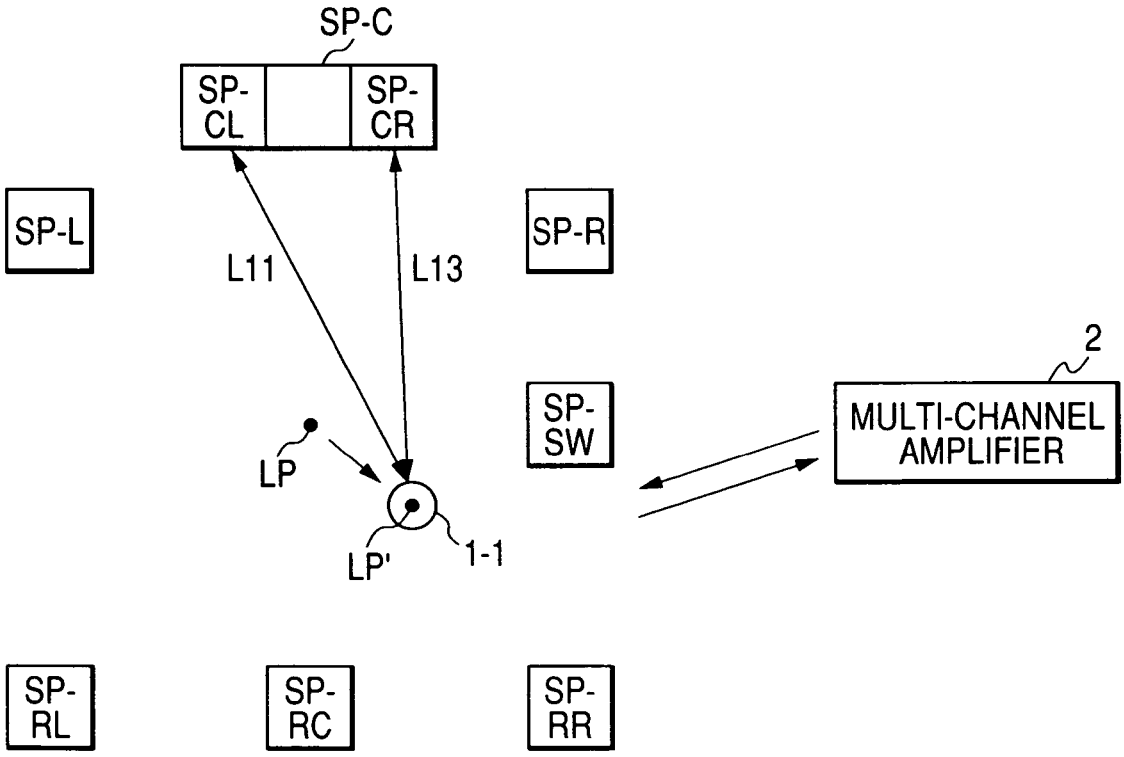
FIG. 6 is a diagram for explaining the process when the listening position is changed according to the second embodiment of the present invention.

First, a listener installs the sensor 1-1 in a changed listening position LP' as shown in FIG. 6. In this event, the sensor 1-2 may not have to be installed.

The measuring signal generating portion 25 of the multi-channel amplifier 2 generates a measuring signal for detecting a speaker position (Step 201 in FIG. 5). In this event, assume that the changeover switch 23 supplies the measuring signal to the center speaker SP-C, but does not supply the signal to the other speakers. In addition, assume that the measuring signal is supplied to only the left speaker SP-CL of the center speaker SP-C, but the measuring signal is not supplied to the right speaker SP-CR of the center speaker SP-C.

Processing of Steps 202-204 is the same as that of Steps 102-104 in FIG. 3. The position calculating portion 28 calculates the distance L11 between the speaker SP-CL and the sensor 1-1 based on the time difference measured by the sensor 1-1 and the sonic velocity (Step 205).

Subsequently, return to Step 201. Processing from Step 201 to Step 205 is carried out again. Here, assume that the measuring signal is supplied to only the right speaker SP-CR of the center speaker SP-C, but the measuring signal is not supplied to the left speaker SP-CL of the center speaker SP-C. The position calculating portion 28 calculates the distance L13 between the speaker SP-CR and the sensor 1-1 based on the time difference measured by the sensor 1-1 and the sonic velocity (Step 205).

After termination of calculation of the distances (YES in Step 206), the position calculating portion 28 calculates the position of the sensor 1-1 (listening position LP') with respect to the center speaker SP-C trigonometrically from the known distance L0 between the speakers SP-CL and SP-CR and the calculated distances L11 and L13 (Step 207). The positions of the speakers SP-L, SP-R, SP-RL, SP-RR, SP-C and SP-RC and the subwoofer SP-SW with respect to the listening position LP before the change are stored in the position table 29 in advance. The position calculating portion 28 calculates the position of each speaker with respect to the changed listening position LP' based on the position of the speaker stored in the position table 29 and the calculated position of the sensor 1-1, and updates the position of the speaker stored in the position table 29 (Step 208).

The sound field control portion 31 controls the sound field processing portion 22 to correct the sound field based on the position of each speaker stored in the position table 29 (Step 209). This sound field correction process is the same as that of Step 117 in FIG. 3.

In such a manner, according to this embodiment, it is possible to deal with a change of the listening position LP.

When there is an obstacle between the changed listening position LP' and the center speaker SP-C, the time difference between the time instant when the reference signal is received and the time instant when the measuring sound wave is received cannot be measured correctly by the sensor 1-1. In such a case, for example, in accordance with listener's designation, the changeover switch 23 may be manually controlled to perform the processing of Steps 201-206 using other speakers with no obstacle between the speakers and the listening position LP'. It will go well if the position of the sensor 1-1 is detected thus. The number of speakers required for detecting the position of the sensor 1-1 is at least two.

When four or more speakers are used, the position of the sensor 1-1 can be detected automatically even if there is an obstacle between one of the speakers and the changed listening position LP'. For example, the number of combinations is six when measuring is performed with two speakers selected from four speakers each time. Therefore, the position calculating portion 28 performs the processing of Steps 201-207 upon each of the six combinations. When the positions of the sensor 1-1 calculated in all the combinations are substantially coincident with each other (when an error between these positions is not higher than a predetermined threshold value), this position is used as a correct value.

Assume that the calculated positions of the sensor 1-1 are substantially coincident to each other in three combinations, and the calculated positions of the sensor 1-1 are greatly different from each other in the other combinations. In this case, the substantially coincident position of the sensor 1-1 is used as a correct value.

When there are no combination in which the positions of the sensor 1-1 are substantially coincident to each other, it can be considered that at least two speakers are not suitable for measuring. In this case, the position calculating portion 28 performs the processing of Steps 201-207 with another selected combination of four speakers different from the four speakers used for measuring. Thus, the combination is selected to include three or more speakers in which the positions of the sensor 1-1 are substantially coincident.

Third Embodiment

Figure 7:
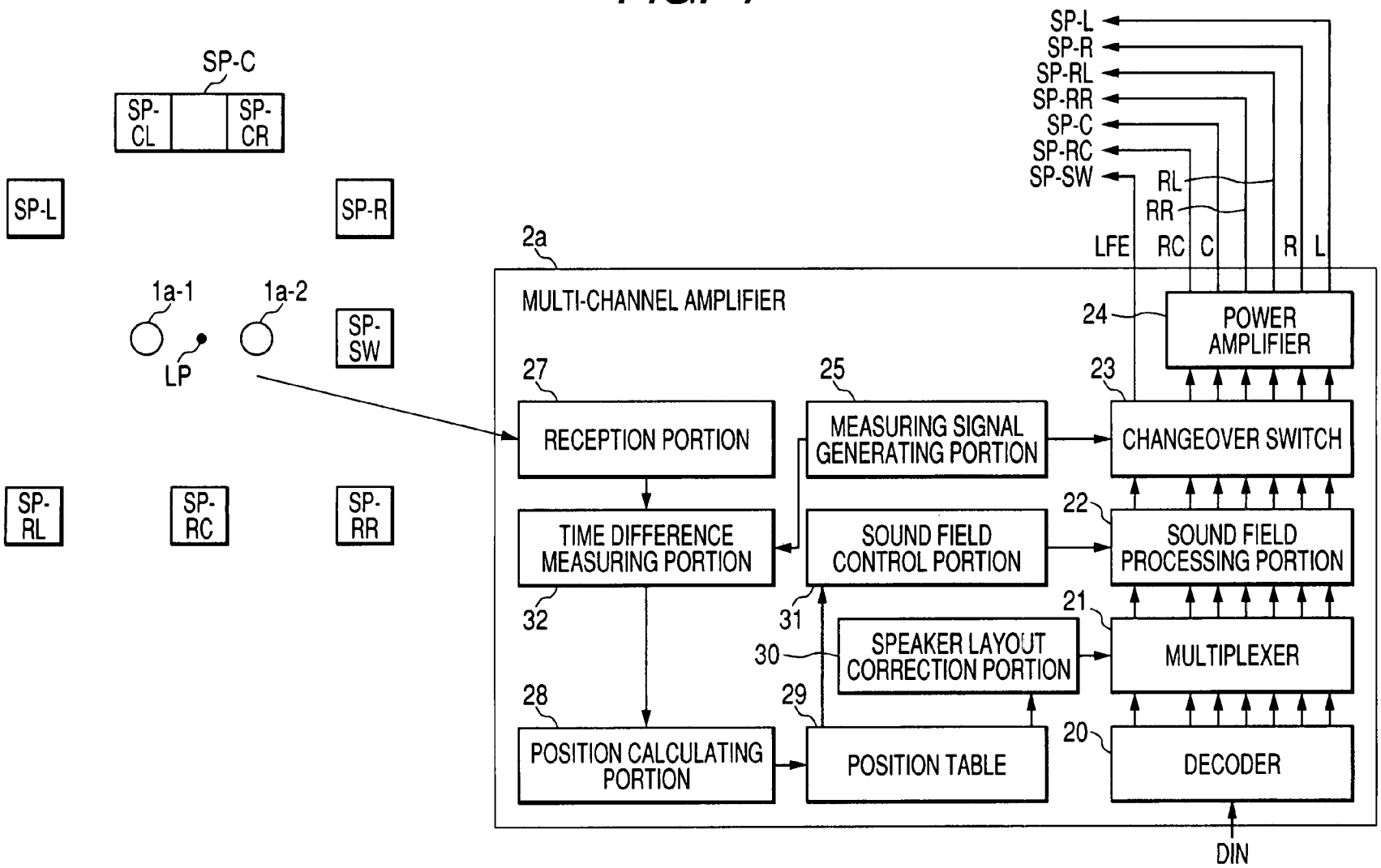
FIG. 7 is a block diagram showing the configuration of a sound reproducing apparatus according to a third embodiment of the present invention.

Next, description will be made on a third embodiment of the present invention. FIG. 7 is a block diagram showing the configuration of a sound reproducing apparatus according to the third embodiment of the present invention. Constituents the same as those in FIG. 1 are referenced correspondingly. The sound reproducing apparatus in FIG. 7 includes sensors 1*a* (1*a*-1 and 1*a*-2) and a multi-channel amplifier 2*a*.

Although a time difference for calculating a distance between a speaker and a sensor is measured by the sensor 1 in the first embodiment, a time difference measuring portion 32 for measuring a time difference is provided in the multi-channel amplifier 2*a* in this embodiment.

Figure 8:
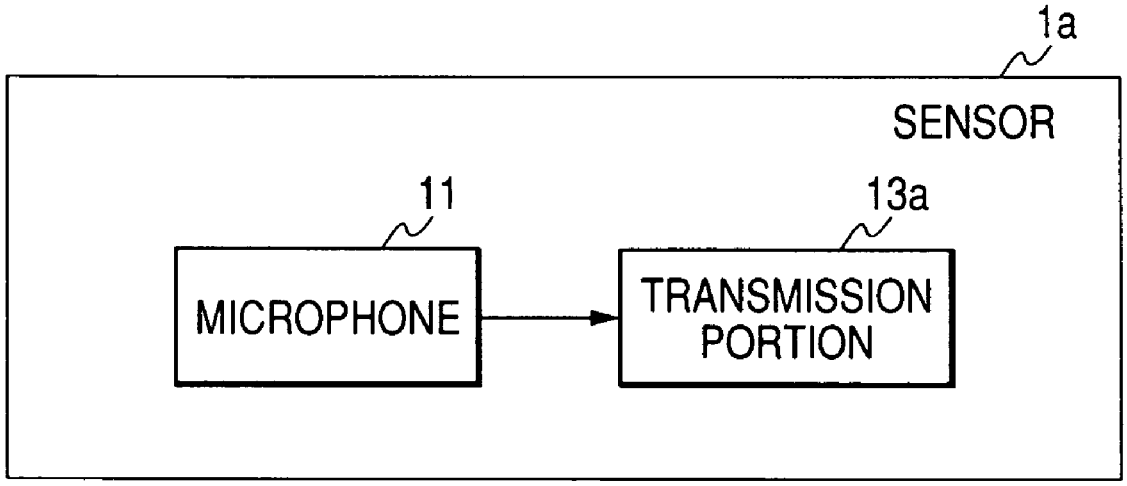
FIG. 8 is a block diagram showing the configuration of each sensor in the sound reproducing apparatus according to the third embodiment of the present invention.

FIG. 8 is a block diagram showing the configuration of each sensor 1*a* (1*a*-1, 1*a*-2). The sensor 1*a* has a microphone 11 and a transmission portion 13*a*.

Figure 9:
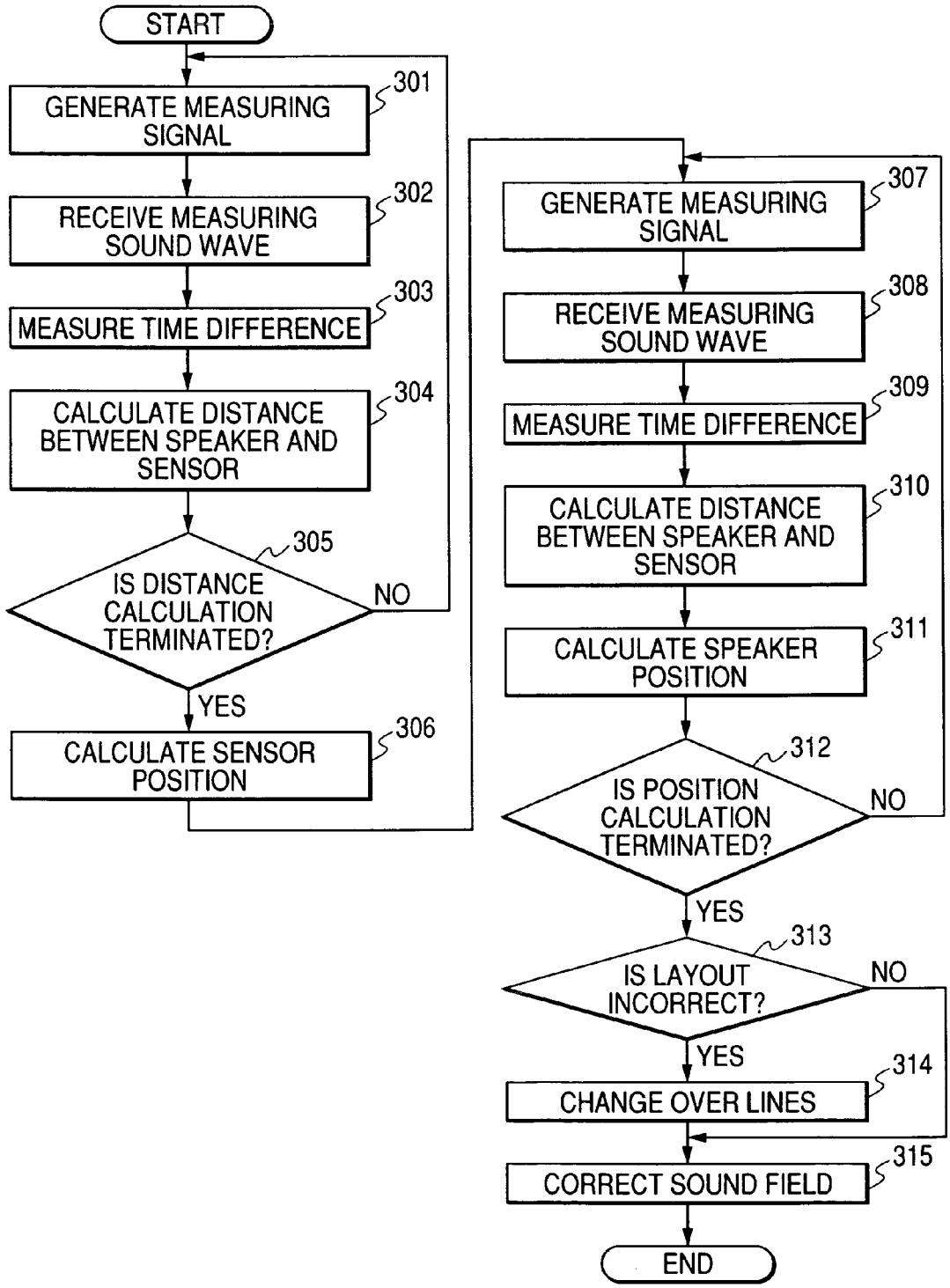
FIG. 9 is a flow chart showing a sound field correction process in the sound reproducing apparatus according to the third embodiment of the present invention.

FIG. 9 is a flow chart showing a sound field correction process according to this embodiment. In the same manner as in the first embodiment, a listener installs the sensors 1*a*-1 and 1*a*-2 in a listening room so that a listening position LP is put between the sensors 1*a*-1 and 1*a*-2.

Processing of Step 301 in FIG. 9 is the same as that of Step 101 in FIG. 3, in which a measuring signal is supplied from a measuring signal generating portion 25 of the multi-channel amplifier 2*a* to a speaker SP-CL.

When the measuring signal (measuring sound wave) radiated from the speaker SP-CL is received by a microphone 11, a transmission portion 13*a* of the sensor 1*a*-1 sends a notification signal to the multi-channel amplifier 2*a* so as to notify the multi-channel amplifier 2*a* of the fact that the measuring sound wave has been received (Step 302). Such a reception notification is also sent from the sensor 1*a*-2 in the same manner.

When receiving a notification signal from each sensor 1*a*-1, 1*a*-2, a reception portion 27 of the multi-channel amplifier 2*a* notifies a time difference measuring portion 32 of this reception. The time difference measuring portion 32 measures a time difference between the time instant when the measuring signal was generated from the measuring signal generating portion 25 and the time instant when the reception notification was received from the sensor 1*a*-1. In the same manner, the time difference measuring portion 32 measures a time difference between the time instant when the measuring signal was generated and the time instant when the reception notification was received from the sensor 1*a*-2. The time difference measuring portion 32 notifies a position calculating portion 28 of the measured time differences (Step 303).

Here, description will be made on calculation of a distance between a speaker and a sensor. As described with reference to FIG. 4, the time difference between the time instant when the measuring signal was generated and the time instant when this measuring signal reached the speaker SP-CL can be regarded as approximately zero. Thus, the position calculating portion 28 calculates a distance L11 between the speaker SP-CL and the sensor 1*a*-1 based on the time difference between the time instant when the measuring signal was generated and the time instant when the reception notification was received from the sensor 1*a*-1, and the sonic velocity, and calculates a distance L12 between the speaker SP-CL and the sensor 1*a*-2 based on the time difference between the time instant when the measuring signal was generated and the time instant when the reception notification was received from the sensor 1*a*-2, and the sonic velocity (Step 304).

Subsequently, return to Step 301. Processing from Step 301 to Step 304 is carried out again. Here, assume that the measuring signal is supplied to only the right speaker SP-CR of the center speaker SP-C, but the measuring signal is not supplied to the left speaker SP-CL of the center speaker SP-C. The position calculating portion 28 calculates a distance between the speaker SP-CR and the sensor 1*a*-1 based on the time difference between the time instant when the measuring signal was generated from the measuring signal generating portion 25 and the time instant when the reception notification was received from the sensor 1*a*-1, and the sonic velocity, and calculates a distance between the speaker SP-CR and the sensor 1*a*-2 based on the time difference between the time instant when the measuring signal was generated and the time instant when the reception notification was received from the sensor 1*a*-2, and the sonic velocity (Step 304).

After termination of calculation of the distances (YES in Step 305), the position calculating portion 28 calculates the positions of the sensors 1-1*a* and 1*a*-2 and the speaker SP-C with respect to a listening position LP, and a distance Lx between the sensors 1*a*-1 and 1*a*-2, and stores the calculated positions and the distance Lx into a position table 29 (Step 306). This processing of Step 306 is similar to that of Step 107 in FIG. 3.

Next, the positions of the other speakers SP-L, SP-R, SP-RL, SP-RR, SP-RC and SP-SW are detected.

Processing of Step 307 in FIG. 9 is the same as that of Step 108 in FIG. 3. Processing of Steps 308 and 309 is similar to that of Steps 302 and 303 respectively. When the measuring sound wave radiated from the speaker SP-L is received by the sensor 1*a*-1, 1*a*-2, a notification signal is sent to the multi-channel amplifier 2*a* so as to notify the multi-channel amplifier 2*a* of this reception. The time difference measuring portion 32 of the multi-channel amplifier 2*a* measures a time difference between the time instant when the measuring signal was generated from the measuring signal generating portion 25 and the time instant when the reception notification was received from the sensor 1*a*-1, and calculates a time difference between the time instant when the measuring signal was generated and the time instant when the reception notification was received from the sensor 1*a*-2.

The position calculating portion 28 calculates a distance L15 between the speaker SP-L and the sensor 1*a*-1 based on a time difference between the time instant when the measuring signal was generated and the time instant when the reception notification was received from the sensor 1*a*-1, and the sonic velocity, and calculates a distance L16 between the speaker SP-L and the sensor 1*a*-2 based on a time difference between the time instant when the measuring signal was generated and the time instant when the reception notification was received from the sensor 1*a*-2, and the sonic velocity (Step 310).

Subsequently, the position calculating portion 28 calculates the position of the main speaker SP-L with respect to the sensors 1*a*-1 and 1*a*-2 trigonometrically from the distance Lx between the sensors 1*a*-1 and 1*a*-2 stored in the position table 29 and the calculated distances L15 and L16, and calculates the position of the main speaker SP-L with respect to the listening position LP based on this calculation result and the positions of the sensors 1*a*-1 and 1*a*-2 stored in the position table 29, so that the position calculating portion 28 stores this position of the speaker SP-L in the position table 29 (Step 311).

The processing of Steps 307-311 as described above are carried out upon the other speakers SP-R, SP-RL, SP-RR, SP-RC and SP-SW in turn.

Processing of Steps 313, 314 and 315 is the same as that of Steps 115, 116 and 117 in FIG. 3 respectively.

In such a manner, according to this embodiment, time differences are measured by the multi-channel amplifier 2*a* so as to calculate a distance between a speaker and a sensor. It is therefore possible to obtain an effect similar to that of the first embodiment.

When the distance Lx between the sensors 1-1 and 1-2 is known, the processing of Steps 301-306 does not have to be carried out, but it will go well if the positions of the speakers SP-L, SP-R, SP-RL, SP-RR, SP-C and SP-RC and the subwoofer SP-SW are detected in the processing of Steps 307-312.

Fourth Embodiment

Figure 10:
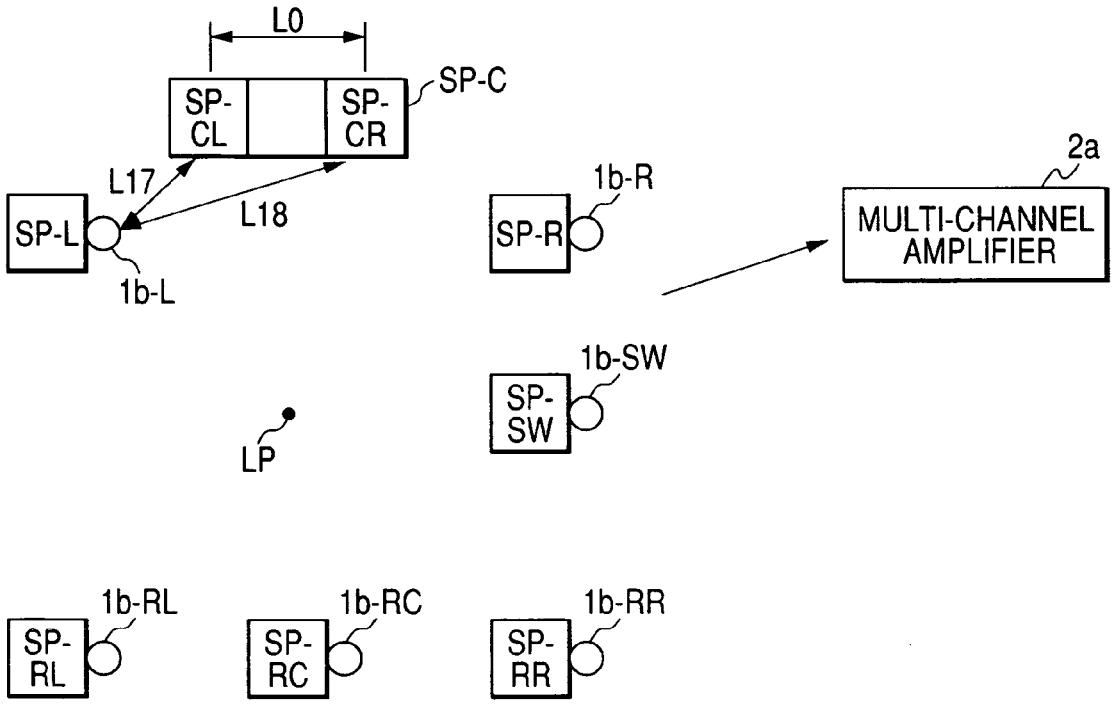
FIG. 10 is a diagram for explaining a speaker position detection process according to a fourth embodiment of the present invention.

Next, description will be made on a fourth embodiment of the present invention. FIG. 10 is a diagram for explaining a speaker position detection process according to this embodiment. The configuration of a multi-channel amplifier is similar to that in the third embodiment. Therefore, description will be made using the reference numerals in FIG. 7.

It is assumed in this embodiment that the position of a center speaker SP-C with respect to a listening position LP is set in a position table 29 of a multi-channel amplifier 2*a* by a listener in advance. Sensors 1*b*-L, 1*b*-R, 1*b*-RL, 1*b*-RR, 1*b*-RC and 1*b*-SW for detecting speaker positions are attached to cabinets of speakers SP-L, SP-R, SP-RL, SP-RR, SP-RC and SP-SW respectively. The configuration of each sensor 1*b*-L, 1*b*-R, 1*b*-RL, 1*b*-RR, 1*b*-RC, 1*b*-SW is the same as that of the sensor 1*a* shown in FIG. 8. Since the position of the center speaker SP-C is known, it is not necessary to provide a sensor therefor. Each of these sensors may receive a measuring signal by use of the speaker as a microphone, to which the sensor should be attached, and send the measuring signal to the multi-channel amplifier 2*a* by use of a speaker cable.

Figure 11:
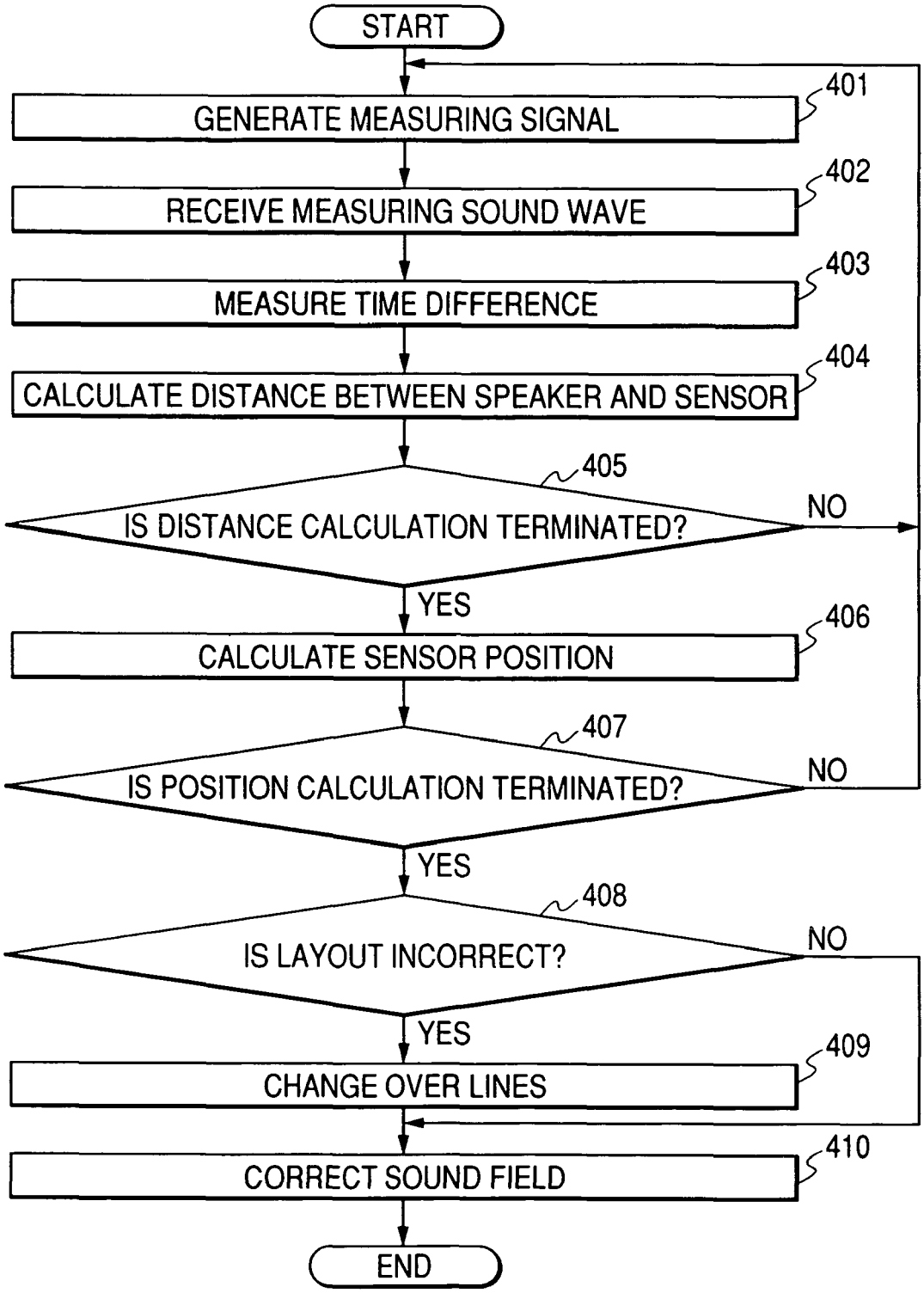
FIG. 11 is a flow chart showing a sound field correction process in a sound reproducing apparatus according to the fourth embodiment of the present invention.

FIG. 11 is a flow chart showing a sound field correction process according to this embodiment. Processing of Step 401 in FIG. 11 is the same as that of Step 101 in FIG. 3, in which a measuring signal is supplied from a measuring signal generating portion 25 of the multi-channel amplifier 2*a* to the speaker SP-CL.

When the measuring signal (measuring sound wave) radiated from the speaker SP-CL is received by a microphone 11, the sensor 1*b*-L of the main speaker SP-L sends a notification signal to the multi-channel amplifier 2*a* so as to notify the multi-channel amplifier 2*a* of the fact that the measuring sound wave has been received (Step 402).

A time difference measuring portion 32 of the multi-channel amplifier 2*a* measures a time difference between the time instant when the measuring signal was generated from the measuring signal generating portion 25 and the time instant when the reception notification was received from the sensor 1*b*-L through a reception portion 27. The time difference measuring portion 32 notifies a position calculating portion 28 of the measured time difference (Step 403).

The position calculating portion 28 calculates a distance L17 between the speaker SP-CL and the sensor 1*b*-L based on the measured time difference and the sonic velocity (Step 404).

Subsequently, return to Step 401. Processing from Step 401 to Step 404 is carried out again. Here, assume that the measuring signal is supplied to only a right speaker SP-CR of the center speaker SP-C, but the measuring signal is not supplied to a left speaker SP-CL of the center speaker SP-C. The position calculating portion 28 calculates a distance L18 between the speaker SP-CR and the sensor 1*b*-L based on the time difference measured by the time difference measuring portion 32, and the sonic velocity (Step 404).

After distances between the speakers SP-CL and SP-CR and the sensor 1*b*-1L are calculated individually (YES in Step 405), the position calculating portion 28 calculates the position of the sensor 1*b*-L, that is, the position of the main speaker SP-L with respect to the center speaker SP-C trigonometrically from a known distance L0 between the speakers SP-CL and SP-CR and the calculated distances L17 and L18 (Step 406). Since the position of the center speaker SP-C with respect to the listening position LP has been stored in the position table 29, the position of the main speaker SP-L with respect to the listening position LP can be obtained. The position calculating portion 28 stores this position of the main speaker SP-L into the position table 29.

The processing of Steps 401-406 for detecting a speaker position using the speakers SP-CL and SP-CR in the aforementioned manner is performed upon the other speakers SP-R, SP-RL, SP-RR, SP-RC and SP-SW in turn.

After termination of calculation of each speaker position (YES in Step 407), go to Step 408. Processing of Steps 408, 409 and 410 is the same as that of Steps 115, 116 and 117 in FIG. 3 respectively.

In such a manner, according to this embodiment, the two speakers SP-CL and SP-CR having known positions with respect to the listening position LP are used for detecting positions of the other speakers to which the sensors have been attached. Thus, it is possible to obtain an effect similar to that of the first embodiment.

In the fourth embodiment, configuration is made so that sensors are attached to the speakers SP-CL and SP-CR and a measuring signal is supplied to each speaker SP-L, SP-R, SP-SW, SP-RL, SP-RC, SP-RR. In this configuration, when, for example, the position of the speaker SP-L is to be measured, a measuring signal is supplied from the measuring signal generating portion 25 to the speaker SP-L, and the measuring signal (measuring sound wave) radiated from the speaker SP-L is received by the sensor attached to the speaker SP-CL. The time difference measuring portion 32 measures a time difference between the time instant when the measuring signal was generated from the measuring signal generating portion 25 and the time instant when a reception notification was received through the reception portion 27 from the sensor attached to the speaker SP-CL. The time difference measuring portion 32 notifies the position calculating portion 28 of the measured time difference. Processing to be performed subsequently is the same as the aforementioned processing. Thus, the position of the speaker SP-L can be calculated.

The measuring signal (measuring sound wave) used in the first to fourth embodiments may be a signal in an audio band or an ultrasonic signal out of the audio band. The measuring signal may be supplied to each speaker through a normal speaker cable or by use of a dedicated signal line. When an ultrasonic signal is used as the measuring signal, an ultrasonic wave may be generated from an ultrasonic transducer attached to a cabinet of each speaker. When an ultrasonic signal is used as the measuring signal, there is an advantage that measuring can be performed silently. When an audio-band signal is used, the accuracy of distance measurement deteriorates due to the long wavelength. The accuracy of distance measurement can be improved when an ultrasonic signal is used.

In the first to fourth embodiments, the position of each speaker is detected two-dimensionally. In the first to third embodiments, it will go well if n (n is a natural number not smaller than 2) measuring speakers and n sensors are used. In the fourth embodiment, it will go well if n measuring speakers are used. When $n \geqq 3$, the position of each speaker can be detected three-dimensionally.

In the first to fourth embodiments, description has been made on a 6.1-channel digital surround-sound system by way of example. However, the present invention is applicable to any system if the system has two or more channels.

In the first and second embodiments, an electromagnetic wave is used as the second measuring signal. However, the second measuring signal may be transmitted to each sensor by wire.

The present invention is applicable to a sound reproducing apparatus for driving a plurality of speakers to reproduce multi-channel sound.

The invention claimed is:

1. A sound reproducing apparatus for driving a plurality of speakers with two of the speakers having a known distance therebetween to reproduce multi-channel sound, the sound reproducing apparatus comprising:

a generator configured to generate a measuring signal and supply the measuring signal to each of the plurality of speakers;

at least two sensors positionable to a listening position, each of the at least two sensors transmitting a reception notification when receiving a measuring sound wave radiated from each of the speakers in accordance with the measuring signal;

a time difference measuring unit configured to measure a time difference between a time instant when the measuring signal is generated and a time instant when the reception notification is received from each of the at least two sensors;

a distance calculator configured to calculate a distance between the at least two sensors and a distance between each of the at least two sensors and each of the two speakers based on the measured time difference and the known distance between the two speakers;

a position calculator configured to calculate a position of each of the two speakers based on the calculated distance between the at least two sensors and the calculated distance between each of the two speakers from each of the at least two sensors; and a storage that stores the calculated position of the two speakers relative to the at least two sensors.

2. The sound reproducing apparatus according to claim 1, further comprising a sound field controller configured to produce sound image localization as if the speakers were located in predetermined recommended positions, respectively, based on respective positions of the speakers stored in the storage.

3. The sound reproducing apparatus according to claim 1, wherein each of the at least two sensors is positionable independent of the other.

4. A method of identifying a position of each of a plurality of speakers using at least two sensors disposed in a listening position, the method comprising the steps of:

supplying the measuring signal in turn to two of the plurality of speakers having a known distance from each other;

transmitting a reception notification when each of the at least two sensors receives a measuring sound wave radiated from each of the two speakers in accordance with the measuring signal;

measuring a time difference between a time instant when the measuring signal is generated and a time instant when the reception notification is received from each of the at least two sensors for each of the two speakers;

calculating a distance between the at least two sensors and a distance between each of the two sensors and each of the two speakers based on the measured time difference and the known distance between the two speakers;

calculating positions of the at least two sensors relative to the two speakers based on the calculated distance between the at least two sensors and the calculated distance between each of the two speakers and each of the at least two sensors;

calculating a position of each of the other of the plurality of speakers based on the calculated positions of the at least two sensors relative to the two speakers; and storing the calculated position of each of the speakers into a storage.

5. The method according to claim 4, wherein each of the at least two sensors is positionable independent of the other.

* * * * *

UNITED STATES PATENT AND TRADEMARK OFFICE

CERTIFICATE OF CORRECTION

PATENT NO. : 7,933,418 B2
APPLICATION NO. : 10/589783
DATED : April 26, 2011
INVENTOR(S) : Morishima It is certified that error appears in the above-identified patent and that said Letters Patent is hereby corrected as shown below:

Title Page, in section (75) Inventor field correct the inventors residence as follows:

REMOVE: Hamamatsu

INSERT --Fukuroi-shi--

Signed and Sealed this
Twenty-eighth Day of June, 2011

David J. Kappos

David J. Kappos
*Director of the United States Patent and Trademark Office*